US005099675A

United States Patent [19]

Heath

[11] Patent Number: 5,099,675

[45] Date of Patent: Mar. 31, 1992

[54] PUNCH AND DIE ASSEMBLY FOR BENDING OPERATIONS

[75] Inventor: Roger K. Heath, Uxbridge, Mass.

[73] Assignee: Century Manufacturing Co., Inc., Holliston, Mass.

[21] Appl. No.: 645,722

[22] Filed: Jan. 25, 1991

[51] Int. Cl.[5] ..... B21D 5/00

[52] U.S. Cl. ..... 72/415; 72/311; 72/382; 72/389; 72/379.2; 72/465

[58] Field of Search ..... 72/465, 462, 382, 389, 72/311, 312, 460, 412, 415, 379.2; 29/21.1, 243.5

[56] References Cited

U.S. PATENT DOCUMENTS

| | | | |
|---|---|---|---|
| 2,473,533 | 6/1949 | Lebedeff | 72/382 |
| 3,978,706 | 9/1976 | Nakagawa | 72/465 |
| 4,825,525 | 5/1989 | Obrecht | 29/21.1 |

FOREIGN PATENT DOCUMENTS

| | | | |
|---|---|---|---|
| 2805206 | 8/1979 | Fed. Rep. of Germany | 72/389 |
| 42123 | 3/1984 | Japan | 72/389 |
| 721172 | 3/1980 | U.S.S.R. | 72/382 |

*Primary Examiner*—Daniel C. Crane

*Attorney, Agent, or Firm*—John E. Toupal; Harold G. Jarcho

[57] ABSTRACT

A punch and die assembly including a punch having an outer surface conforming generally to a configuration desired for a sheet metal part to be produced and adapted for rectilinear movement in a given direction between retracted and extended positions, the punch having a rear portion with a cross-section of given width and a front portion with a cross-section of predetermined width greater than the given width; and a die body defining a cavity comprising an outer portion defining an opening for receiving the punch and an inner portion communicating with the outer portion. The inner portion has a cross-section with substantially uniformly spaced side walls dimensioned so as to closely accommodate the front portion of the punch and a sheet metal workpiece, and to provide between said rear portion of the punch and the side walls a gap greater than twice the thickness of the workpiece when the punch is in its extended position within the outer portion of said cavity. In addition, the inner portion of the cavity extends transversely to the given direction and beyond each of the side walls so as to form reentrant leg portions of the die body, the leg portions terminating with at least one of the side walls. The reentrant leg portions squeeze the workpiece at the end of the punch stroke to create high precision bends.

17 Claims, 3 Drawing Sheets

PUNCH AND DIE ASSEMBLY FOR BENDING OPERATIONS

BACKGROUND OF THE INVENTION

This invention relates generally to a punch and die assembly and, more particularly, to a punch and die assembly for bending sheet metal workpieces.

Punch and die assemblies are used extensively to bend deformable workpieces such as metal sheets into piece parts having desired profiles. Often, piece part profiles having a high dimensional precision are required. In addition, many applications require finished piece parts that have not been damaged during the bending process.

The object of this invention, therefore, is to provide an improved punch and die assembly for bending deformable workpieces with high dimensional precision and without introducing structural damage to the finished piece parts.

SUMMARY OF THE INVENTION

The invention is a punch and die assembly including a punch having an outer surface conforming generally to a configuration desired for a sheet metal part to be produced and adapted for rectilinear movement in a give direction between retracted and extended positions, the punch having a rear portion with a cross-section of given width and a front portion with a cross-section of predetermined width greater than the given width; and a die body defining a cavity comprising an outer position defining an opening for receiving the punch and an inner portion communicating with the outer portion. The inner portion has a cross-section with substantially uniformly spaced side walls dimensioned so as to closely accommodate the front portion of the punch and a sheet metal workpiece, and to provide between said rear portion of the punch and the side walls a gap greater than twice the thickness of the workpiece when the punch is in its extended position within the outer portion of said cavity. In addition, the inner portion of the cavity extends transversely to the given direction and beyond each of the side walls so as to form reentrant leg portions of the die body, the leg portions terminating with at least one of the side walls. The reentrant leg portions squeeze the workpiece at the end of the punch stroke to create high precision bends.

According to one feature, the invention includes a base supporting the die body, the base and the die body defines a void separated from the inner portion of the cavity by a web portion of the die body, and during movement of the punch into its extended position the web portion is adapted to flex into the void causing closure movement of the one side wall into the gap. The web produces the desired squeezing of the piece part.

According to another feature of the invention, the void is formed between a planar support surface of the base and a concave outer surface of the web portion which defines a convex inner surface facing the inner portion of the cavity. A web portion with this configuration facilitates the desired bending operation.

According to yet other features of the invention, the outer surface is circular with a radius $R^1$, the inner surface is circular with a radius $R^2$ and the same center as the outer surface, $R^2$ is greater than $R^1$, and the planar support surface is separated from the outer surface by a minimum radial distance of 0.03 inches. Desired performance is enhanced by provision of a die body with these structural characteristics.

According to still another feature of the invention, the reentrant leg portions comprise a pair of leg portions, each terminating with a different one of the side walls, and movement of the punch causes closure movement of each said side wall into the gap. This arrangement facilitates the production of symmetrical piece parts.

According to a further feature of the invention, the die body comprises a pad portion exending from the web portion into the outer portion of the cavity and arranged to engage the said punch during movement into its extended position. The pad portion provides a stop for the workpiece during a bending operation.

According to further features of the invention, the pad portion is biased in a first position in the outer portion of the cavity and movable into a second position engaging the inner surface of the web portion, and the pad portion is arranged to be engaged by the punch and moved thereby from the first position to the second position. The movable pad portion functions to securely retain the workpiece during the bending process.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
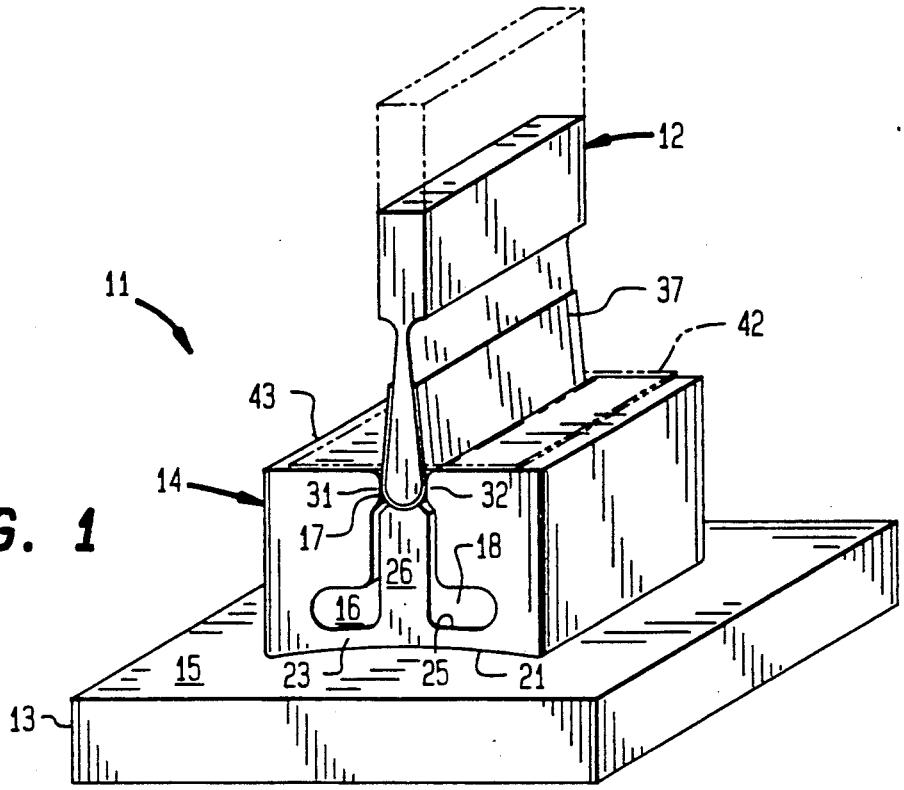
FIG. 1 is a perspective view of a punch and die assembly according to the invention.

A tool and die assembly 11 includes a punch 12, a base 13, and a die body 14 disposed therebetween. The die body 14 is supported on a planar support surface 15 of the base 13. Defined by the die body 14 is a cavity 16 including an outer portion 17 and an inner portion 18. The planar support surface 15 and a concave outer surface 21 of the die body 14 are separated by a void 22. Separating the void 22 from the inner portion 18 of the cavity 16 is a web portion 23 of the die body 14. A convex inner surface 25 of the web portion 23 faces and partially defines the inner portion 18 of the cavity 16. Included in the web portion 23 of the die body 14 is a pad portion 26 that extends upwardly through the inner portion 18 of the cavity 16 into the outer portion 17. The inner portion 18 of the cavity 16 projects transversely on opposite sides of the outer portion 17 so as to establish reentrant leg portions 31 and 32 of the die body 14. Terminating the leg portions 31, 32, respectively, are side walls 33, 34 that straddle and define the outer portion 17 of the cavity 16.

The punch 12 has an outer surface 36 conforming to the shape of a sheet metal part 37 to be produced by the assembly 11. In addition, the punch 12 has a rear portion 38 with a cross section of width D and a front portion 39 with a cross section of width d greater than D. The punch 12 is adapted for movement by a press (not shown) in a direction transverse to the inner portion 18 of the cavity 16 between a retracted position shown by dashed lines in FIGS. 1 and 2 and an extended position within the outer cavity portion 17 as shown by solid lines. During movement of the punch into its extended position, the spacing between the side walls 33, 34 of the legs 31, 32 is such as to closely accommodate the front portion 39 of the punch 12 and the sheet metal part 37. The spacing between the side walls 33, 34, however, is such as to establish with the rear portion 38 of the punch 12 gaps 41 with a total width greater than twice the thickness of the metal part 37.

Figure 2:
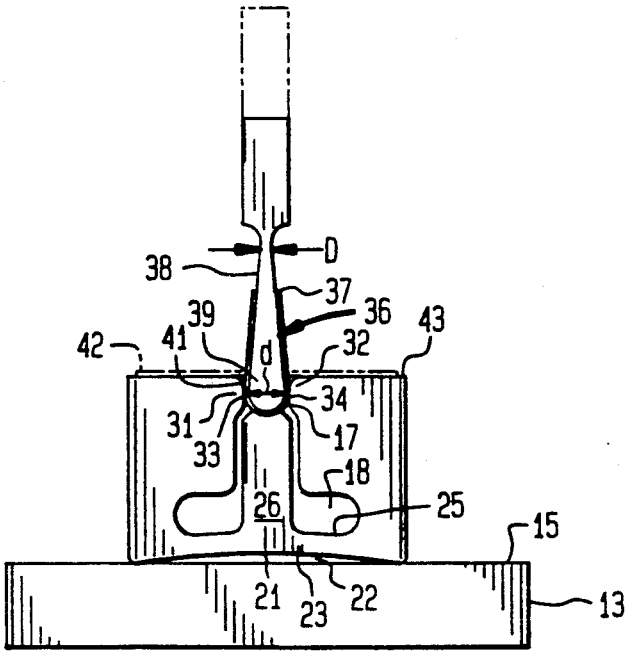
FIG. 2 is a front view of the assembly shown in FIG. 1.
Figure 3:
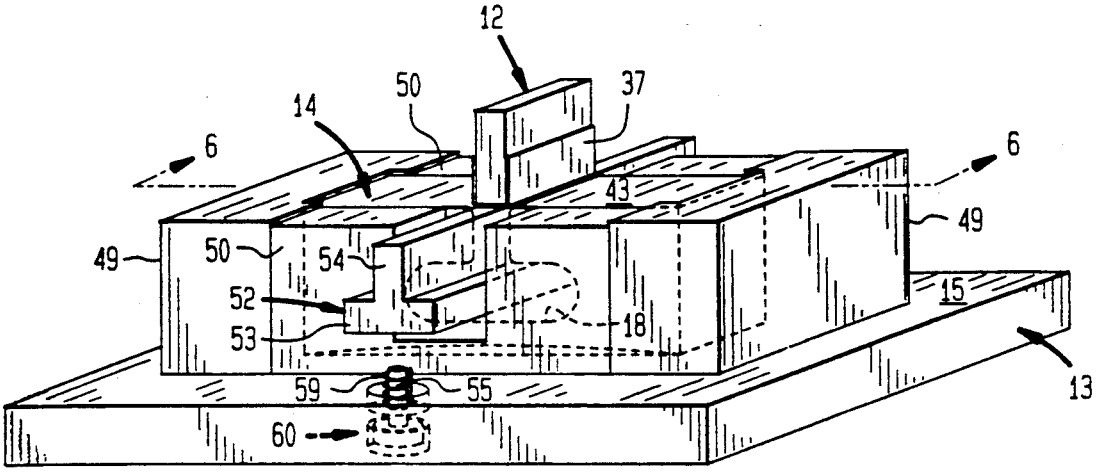
FIG. 3 is a perspective view of another tool punch and die assembly embodiment of the invention.
Figure 4:
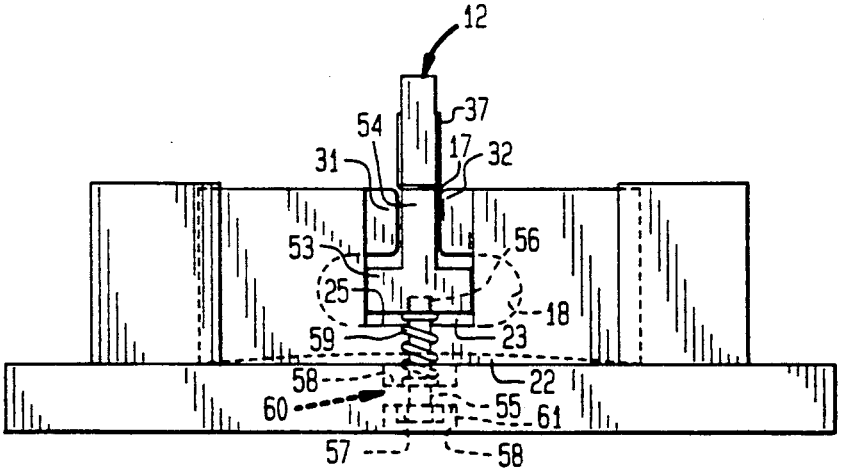
FIG. 4 is a front view of the assembly shown in FIG. 3.
Figure 5:
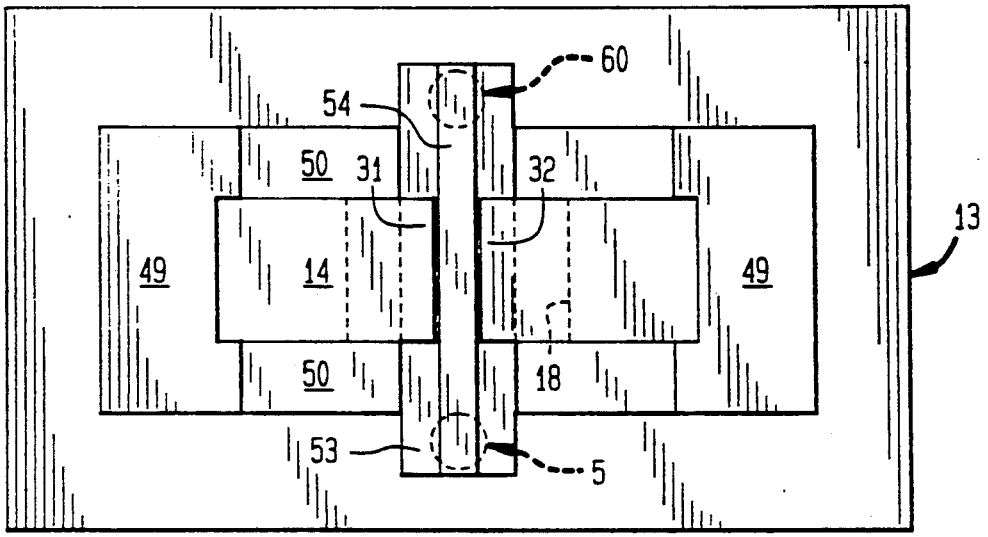
FIG. 5 is a top view of the assembly shown in FIG. 3.
Figure 6:
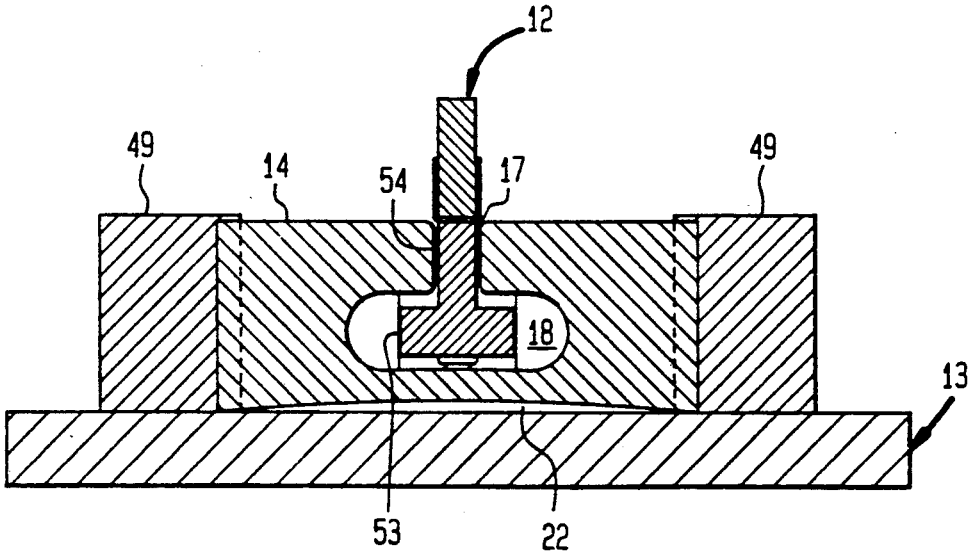
FIG. 6 is a cross-sectional view taken along lines 6—6 in FIG. 3.

During use of the assembly 11, a sheet metal workpiece 42 shown by dashed lines in FIG. 2 is positioned on an upper surface 43 of the die body 14 and over the outer cavity portion 17 while the punch 12 remains in its retracted position. The punch 12 then is moved into its extended position within the outer cavity portion 17 producing engagement between the workpiece 42 and both the upper surface of the pad 26 and the sidewalls 33, 34. That engagement bends workpiece 42 into the sheet metal part 37 of desired shape. Because of the gaps 41 between the sidewalls 33, 34 and the rear portion 38 of the punch 12, undesirable scoring of the part 37 is prevented. In addition, upon movement into its fully extended position, the punch 12 exerts a force on the pad 26 that flexes the web portion 23 downwardly into the void 22. That movement of the web portion 23 is accompanied by closure movement between the reentrant leg portions 31, 32 into the gaps 41. Consequently, the leg portions 31, 32 slightly over bend the sheet metal part 37 insuring a desired shape thereof after a resilient spring back thereof upon completion of the bending operation and removal from the die body 14.

The above described closure action of the legs 31, 32 is enhanced by providing the outer concave surface 21 of the die body 14 and the inner convex surface 25 of the inner cavity portion 18 with co-centered circular curvatures of, respectively, $R^1$ and $R^2$. In addition, for commonly used sheet metal materials of a thickness between 0.015 and 0.060 inches it is desirable that $R^2=R^1+a$ value in a range between 0.1 and 0.25 inches. For sheet metal workpieces of that type, it is further desirable that the maximum spacing between the planar support surface 15 and the concave outer surface 21 of the die body 14 be greater than 0.03 inches.

Another punch and die assembly embodiment 51 is illustrated in FIGS. 3–6. The assembly 51 is similar in form and operation to the embodiment 11 shown in FIGS. 1 and 2 and functionally identical portions of the two assemblies have been given the same reference numerals. Again, a die body 14 is supported on a planar support surface 15 of a base 13 in operative association with a punch 12. Retaining the die body 14 on the base 12 are a pair of end blocks 49 and a pair of straddling guide blocks 50. In embodiment 51, the integrally formed pad portion 26 of embodiment 11 is replaced by a floating pad 52. Forming the floating pad 52 is a base portion 53 disposed in the inner cavity portion 18 and an upwardly extending appendage portion 54 disposed within the outer cavity portion 17.

The floating pad 52 is biased upwardly by a pair of bias assemblies 60 positioned at opposite ends thereof. Each bias assembly includes a screw 55 with an end 56 retained by the base portion 53 and a head 57 disposed within a recess 58 in the base 13. Surrounding the screw 55 and extending between the base portion 53 and a seat 58 in the base 13 is a spring 59. Upward movement of the pad 52 is limited by engagement between the heads 57 of the screws 55 and a stop surface 61 at the inner end of the recesses 58.

The operation of the embodiment 51 is similar to that described above for the embodiment 11. A workpiece 42 is positioned on an upper surface 43 of the die block 14 with the punch 12 in a retracted position. Subsequent movement of the punch 12 to an extended position within the outer cavity portion 17 bends a workpiece into a sheet metal part 37 of desired shape within the outer cavity portion 17. During that movement of the punch 12, the movable pad 52 is moved downwardly producing engagement between the base portion 53 and the inner surface 25 of the web portion 23. Further movement of the punch 12 forces the web portion 23 downwardly into the void 22 producing closure movement of the leg portions 31 and 32 as described above. That movement of the pad 52 is guided by engagement between the base portion 53 and the guide blocks 50. The spring loaded movable pad 52 functions to retain the workpiece 42 in a desired position during movement of the punch between its retracted and extended positions.

Obviously, many modifications and variations of the present invention are possible in light of the above teachings. It is to be understood, therefore, that the invention can be practiced otherwise than as specifically described.

What is claimed:

1. A punch and die assembly for deforming sheet material about the punch comprising:

base means;

a punch having an outer surface conforming generally to a configuration desired for a sheet metal part to be produced and adapted for rectilinear movement in a given direction between retracted and extended positions, said punch having a rear portion with a cross-section of given width and a front portion with a cross-section of predetermined width greater than said given width; and a die body means supported by said base means and defining a cavity comprising an outer portion defining an opening for receiving said punch and an inner portion communicating with said outer portion, said inner portion located furthest from said opening than said outer portion; said outer portion having a cross-section with substantially uniformly spaced side walls dimensioned so as to closely accommodate said front portion of said punch and a sheet metal workpiece, and to provide between said rear portion of said punch and said side walls gaps having a total width greater than twice the thickness of the workpiece when said punch is in said extended position within said outer portion of said cavity; said inner portion of said cavity extending transversely to said given direction and projecting beyond each of said side walls such that said inner portion of said cavity has a greater cross-sectional width than said outer portion of said cavity and so as to form reentrant leg portion means of said die body means, said leg portion means terminating with at least one of said side walls; said base means and said die body means defining a void separated from said inner portion of said cavity by a web portion of said die body means; and wherein during movement into said extended position said punch engages and flexes said web portion said void causing closure movement of said one side wall into said gaps.

2. An assembly according to claim 1 wherein said void is formed between a planar support surface of said base means and a concave outer surface of said web portion, and said web portion defines a convex inner surface facing said inner portion of said cavity.

3. An assembly according to claim 2 wherein said outer surface is circular with a radius $R^1$, said inner surface is circular with a radius $R^2$ and the same center as said outer surface, and wherein $R^2$ is greater than $R^1$.

4. An assembly according to claim 3 wherein said planar support surface is separated from said outer surface by a minimum radial distance of 0.03 inches.

5. An assembly according to claim 1 wherein said reentrant leg portion means comprises a pair of leg portions, each terminating with a different one of said side walls, and said movement of said punch causes closure movement of each said side wall into said gaps.

6. An assembly according to claim 5 including base means supporting said die body means, said base means and said die body means defining a void separated from said inner portion of said cavity by a web portion of said die body means, and wherein during movement of said punch into said extended position said web portion is adapted to flex in to said void causing closure movement of said one side wall into said gaps.

7. An assembly according to claim 6 wherein said void is formed between a planar support surface of said base means and a concave outer surface of said web portion, and said web portion defines a convex inner surface facing said inner portion of said cavity.

8. An assembly according to claim 7 wherein said outer surface is circular with a radius $R^1$, said inner surface is circular with a radius $R^2$ and the same center as said outer surface, and wherein $R^2=R^1+a$ value between 0.1 and 0.25 inches.

9. An assembly according to claim 8 wherein said planar support surface is separated from said outer surface by a minimum radial distance of 0.03 inches.

10. An assembly according to claim 6 wherein said web portion comprises a pad portion extending through said inner portion of said cavity into said outer portion of said cavity and arranged to engage said punch during its movement into said extended position.

11. An assembly according to claim 10 wherein said void is formed between a planar support surface of said base means and a concave outer surface of said web portion, and said web portion defines a convex inner surface facing said inner portion of said cavity.

12. An assembly according to claim 11 wherein said outer surface is circular with a radius $R^1$, said inner surface is circular with a radius $R^2$ and the same center as said outer surface, and wherein $R^2=R^1+a$ value between 0.1 and 0.25 inches.

13. An assembly according to claim 12 wherein said planar support surface is separated from said outer surface by a minimum radial distance of 0.03 inches.

14. An assembly according to claim 10 wherein said pad portion is adapted for movement between a first position in said outer portion of said cavity and a second position engaging said inner surface of said web portion, said pad portion is arranged to be engaged by said punch and moved thereby from said first position to said second position and including bias means biasing said pad portion into said first position.

15. An assembly according to claim 14 wherein said void is formed between a planar support surface of said base means and a concave outer surface of said web portion, and said web portion defines a convex inner surface facing said inner portion of said cavity.

16. An assembly according to claim 15 wheren said outer surface is circular with a radius $R^1$, said inner surface is circular with a radius $R^2$ and the same center as said outer surface, and wherein $R^2=R^1+a$ value between 0.1 and 0.25 inches.

17. An assembly according to claim 16 wherein said planar support surface is separated from said outer surface by a minimum radial distance of 0.03 inches.

* * * * *